US011414956B1

(12) United States Patent
Burris et al.

(10) Patent No.: US 11,414,956 B1
(45) Date of Patent: Aug. 16, 2022

(54) INJECTION VALVE AND METHOD

(71) Applicants: John Burris, Bixby, OK (US); James Sloan, Tulsa, OK (US); Ronald Garr, Inola, OK (US)

(72) Inventors: John Burris, Bixby, OK (US); James Sloan, Tulsa, OK (US); Ronald Garr, Inola, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/191,159

(22) Filed: Mar. 3, 2021

(51) Int. Cl.
*E21B 34/08* (2006.01)
*E21B 43/12* (2006.01)

(52) U.S. Cl.
CPC ..... *E21B 34/08* (2013.01); *E21B 43/12* (2013.01); *E21B 2200/05* (2020.05)

(58) Field of Classification Search
CPC ..... E21B 34/08; E21B 43/12; E21B 2200/05
See application file for complete search history.

(56) References Cited

U.S. PATENT DOCUMENTS

| | | | |
|---|---|---|---|
| 9,624,755 | B2 | 4/2017 | Hill, Jr. et al. |
| 2009/0084556 | A1 | 4/2009 | Richards et al. |
| 2010/0044054 | A1 | 2/2010 | De Boer |
| 2013/0043045 | A1 | 2/2013 | Swietlik et al. |
| 2017/0292347 | A1 | 10/2017 | Mailand et al. |
| 2018/0142534 | A1 | 5/2018 | Mailand et al. |
| 2018/0313189 | A1 | 11/2018 | Hill, Jr. et al. |
| 2018/0334883 | A1* | 11/2018 | Williamson ..... E21B 34/102 |

OTHER PUBLICATIONS

Notification of Transmittal of the International Search Report and the Written Opinion of the International Searching Authority, or the Declaration; PCT/US2022/070863; dated Jun. 7, 2022: 11 pages.

* cited by examiner

*Primary Examiner* — Matthew R Buck
(74) *Attorney, Agent, or Firm* — Cantor Colburn LLP

(57) ABSTRACT

An injection valve including a primary valve having a flapper, a flapper seat configured to seat the flapper, and a flow tube disposed to move relative to the flapper and thereby cause the flapper to be unseated from the flapper seat, a secondary valve disposed within the flow tube, the secondary valve including a secondary housing, and an openable and closable flow port through the secondary housing, and an annular pressure-drop ring disposed between the secondary housing and the flow tube.

16 Claims, 5 Drawing Sheets

INJECTION VALVE AND METHOD

BACKGROUND

In the resource recovery industry there is often need to inject fluids into the borehole environment. There are valves aplenty with hydraulic control lines for actuation and some that are flow pressure actuated. These valves in their various forms work well for their intended purposes but not for alternate purposes. Further, with the rise in interest for carbon dioxide sequestration, the injection of gas that must be pressure managed has added another level of complexity to the tools required. The art will well receive improvements.

SUMMARY

An embodiment of an injection valve including a primary valve having a flapper, a flapper seat configured to seat the flapper, and a flow tube disposed to move relative to the flapper and thereby cause the flapper to be unseated from the flapper seat, a secondary valve disposed within the flow tube, the secondary valve including a secondary housing, and an openable and closable flow port through the secondary housing, and an annular pressure-drop ring disposed between the secondary housing and the flow tube.

An embodiment of a two-stage injection control system including a primary valve having a flapper and a flow tube and having a differential pressure seal radially outwardly of the flow tube, the flow tube responsive to a first pressure applied from uphole of the system, a secondary valve responsive to a second pressure higher than the first pressure to open the secondary valve, and an annular pressure-drop ring disposed between the primary valve and the secondary valve reducing flowing pressure through the secondary valve to maintain uphole pressure above the second pressure such that the primary valve and the secondary valve remain open, during use.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
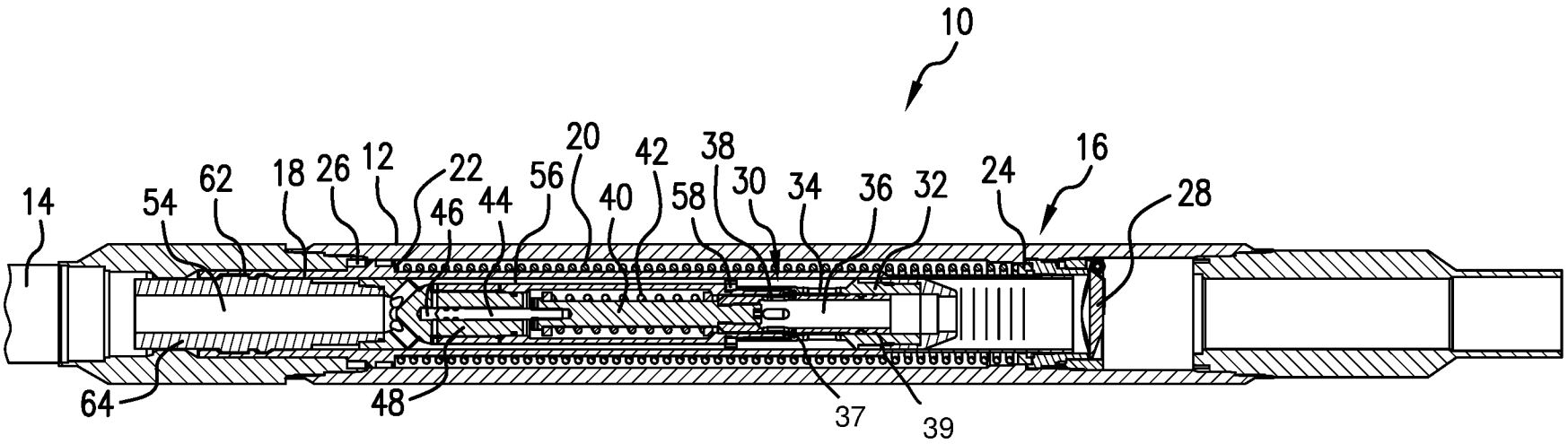
FIG. 1 is a cross section view of a two-stage injection valve a disclosed herein in a closed position.

Referring to FIG. 1, a two-stage injection valve system 10 is illustrated. The injection valve 10 includes a housing 12 that may be made part of a tubing string 14 when in use. Within the housing 12 is a primary valve 16. Valve 16 includes a flow tube 18 disposed within the housing 12 and biased by a biasing member 20 such as a power spring, to a closed position. The power spring extends between a shoulder 22 of the flow tube, which is movable with the flow tube

Figure 2:
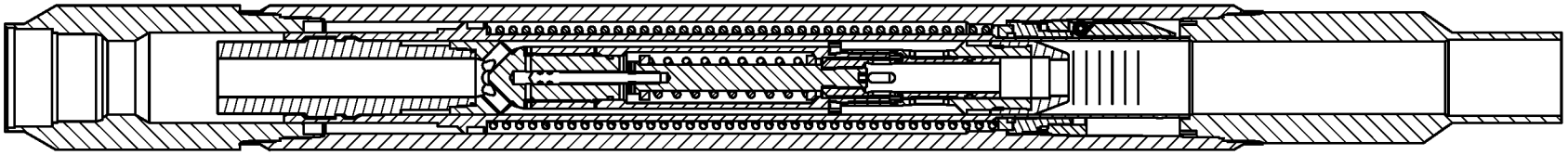
FIG. 2 is the valve of FIG. 1 in a first stage open position.
Figure 3:
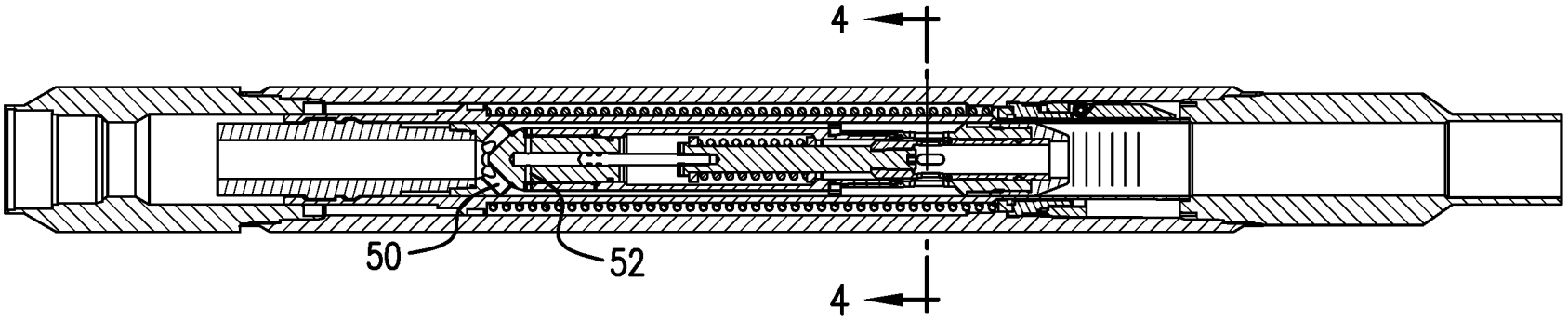
FIG. 3 is the valve of FIG. 1 with both stages open.

18 and a fixed stop 24. The flow tube 18 also includes a seal 26 slidably sealing the flow tube 18 to the housing 12. Primary valve 16 further includes a flapper 28 articulated to the housing 12 and interactive with the flow tube 18. Extension of the flow tube 18 through the flapper 28 opens the primary valve 16, as will be appreciated by one of ordinary skill in the art. Extension of the flow tube 18 is effected by pressuring up from uphole of the injection valve 10. This pressure acts on seal 26. Across seal 26 on the downhole side is downhole pressure. Accordingly, uphole pressure that exceeds the downhole pressure and the spring force of biasing member 20 will cause extension of the flow tube 18 in the downhole direction through the flapper 28, thereby pivoting the flapper 28 to an open position. This is referred to herein as a first pressure and results in the primary valve 16 being open. The injection valve in the position just described may be viewed in FIG. 2. While the primary valve is in the open position, a secondary valve 30 is still in the closed position so that no fluid flows through the injection valve 10 at this stage.

Figure 4:
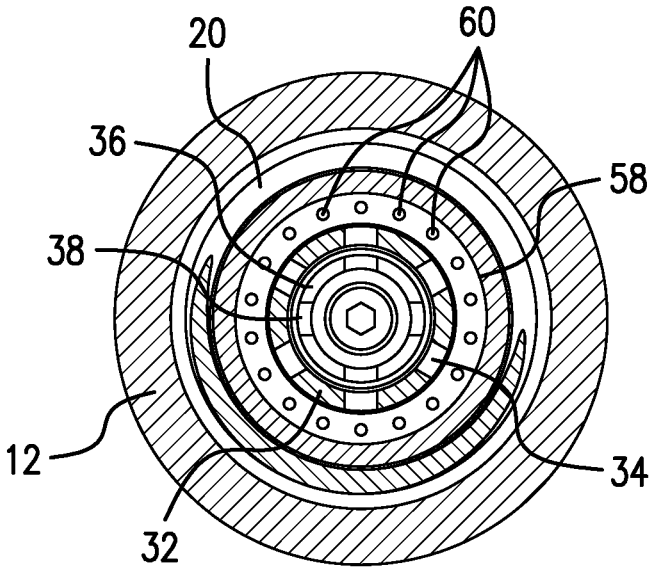
FIG. 4 is a cross section view of FIG. 3 taken along section line 4-4.
Figure 5:
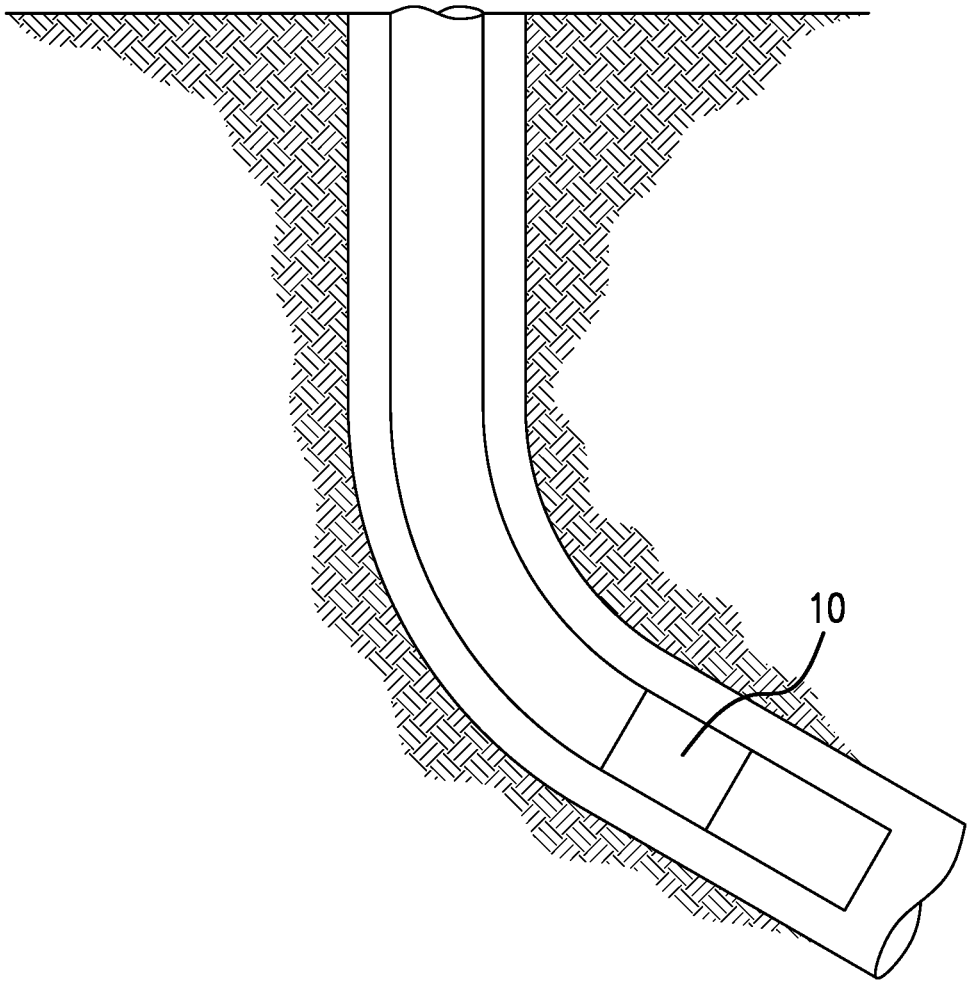
FIG. 5 is a schematic view of a wellbore system with the two-stage injection valve disclosed herein installed.

Within the flow tube 18 is the secondary valve 30. Secondary valve 30 includes a secondary housing 32 having an openable and closable port 34. The port 34 is openable and closable based upon, in one embodiment, a position of a sleeve 36 that has an opening 38 that is alignable (for open) or misalignable (for closed) with the port 34. The sleeve 36 is connected to a bias connector 40 that locates a biasing device 42 such as a spring. Bias connector 40 is connected to a piston rod 44 disposed within a piston chamber 46 of a flow distribution member 48. Flow distribution member 48 includes flow pathway 50 and chamber pathway 52 that allow fluid pressure from uphole through ID 54 to reach the piston rod 44. Uphole pressure on the piston rod 44 is opposed only by downhole pressure plus the resilient force of the biasing device 42. In addition, since there are two seals 37 and 39 on the sleeve 36, a differential area between those two seals can be used to either increase required pressure or decrease required pressure to slide the sleeve 36 to the open position of secondary valve 30. Specifically, if seal 37 is a larger area than seal 39, the net force on sleeve 36 will oppose the force generated at the piston rod 44 and higher actuation pressure will be required. Conversely, if seal 39 is of larger area, the net force on sleeve 36 will complement piston rod 44 and a lower actuation force will be required. The areas of seals 37 and 39 may be manipulated in a manufacturing stage to provide a desired effect. Accordingly, upon uphole pressure exceeding a threshold pressure (a second pressure) for actuating the secondary sleeve 30, that threshold being dictated by these two or three balancing forces, the piston rod 44 will move in the downhole direction thereby aligning the opening 38 with the port 34 so that flow may progress through the secondary valve 30. Simultaneously, flow pathway 50 allows fluid from tubing ID 54 (of the string 14) to reach injection pathway 56. Finally, within injection pathway 56 and disposed between the secondary housing 32 and the flow tube 18 is an annular pressure-drop ring 58. Ring 58 has a number of fixed dimension orifices 60 disposed about the ring and oriented in parallel with a longitudinal axis of the ring. The orifices are best visible in FIG. 4. It is to be understood that the dimensions and shapes of the orifices 60 are fixed in each ring 58 but that among rings 58 they differ. This is to allow an operator to select a particular ring 58 for a pressure drop that works for the particular fluid and viscosity that will be flowed through the injection valve 10, the spring forces of the biasing member 20 and biasing device 42, and other considerations related to what pressure drop will be needed to ensure that both the primary and secondary valves 16 and 30 remain open and that the fluid flowing through the injection valve 10 does not flash Using the correct pressure-drop ring 58 for the parameters noted functions to ensure that pressure remains high enough on the fluid throughout the process to ensure these results. Determining the exact pressure drop required and therefore which ring 58 to select is something that can be easily calculated by one of ordinary skill in the art after having been provided the teaching of this disclosure and with knowledge of the fluid properties of the fluid to be injected.

One important use of the injection valve as disclosed is for injection of a fluid such as carbon dioxide or hydrogen (for example) for sequestration. Rapid reduction in pressure on such fluids in liquid form will cause the liquid to flash to a gaseous form and thereby dramatically reduce temperature of the phase changing fluid and surrounding structure. If this occurs in a valve, the valve will freeze and become inoperable. Obviously, such a condition is undesirable and hence solving that issue is important. The injection valve 10 described herein solves the problem by ensuring that the opening of the injection valve 10 occurs in two stages and that the pressure in the fluid flow remains above a phase change pressure for the particular fluid at the particular temperature where the injection valve 10 is in use. This pressure on the fluid ensures it stays in the liquid phase. This benefit is also of value in the closing sequence of injection valve 10. Specifically, as pressure is bled off at surface or the flow rate is reduced by some other method, the secondary valve 30 will close first at the second pressure and maintain the second pressure downhole of the secondary valve 30. This pressure is to be above the phase transition pressure of the fluid at the temperature where the injection valve 10 is being used. Accordingly, the fluid will not flash as pressure is maintained above the flash pressure in the entire system but below the pressure keeping the secondary valve open. Further reduction of pressure at the injection valve 10 to below the first pressure will cause the primary valve 16 to close. The well is shut in by the secondary valve 30 first and then the flapper of the primary valve 16 is also closed.

Another advantage of the injection valve as disclosed herein is that the secondary valve 30 may be retrieved from the primary valve 16 by wireline leaving a fully open bore for other borehole work. To retrieve the secondary valve 30, a profile engagement 62 between the flow tube 18 and a lock member 64 that is itself connected to the flow distribution member 48, is overcome by overpull and the entire secondary valve 30 is pulled out of the primary valve 16, whereafter secondary valve 30 may be returned to surface.

Set forth below are some embodiments of the foregoing disclosure:

Embodiment 1: An injection valve including a primary valve having a flapper, a flapper seat configured to seat the flapper, and a flow tube disposed to move relative to the flapper and thereby cause the flapper to be unseated from the flapper seat, a secondary valve disposed within the flow tube, the secondary valve including a secondary housing, and an openable and closable flow port through the secondary housing, and an annular pressure-drop ring disposed between the secondary housing and the flow tube.

Embodiment 2: The injection valve as in any prior embodiment, wherein the primary valve further includes a primary housing radially outwardly disposed of the flow tube and a seal disposed between the primary housing and the flow tube.

Embodiment 3: The injection valve as in any prior embodiment, wherein the annular pressure-drop ring includes a number of fixed dimension orifices disposed about the ring.

Embodiment 4: The injection valve as in any prior embodiment, wherein the annular pressure-drop ring is removable and replaceable with a ring having a different number or different dimensions of orifices to adjust pressure drop across the ring.

Embodiment 5: The injection valve as in any prior embodiment, wherein the number of orifices are of the same dimensions as each other.

Embodiment 6: The injection valve as in any prior embodiment, wherein the orifices extend in parallel to a longitudinal axis of the ring.

Embodiment 7: The injection valve as in any prior embodiment, wherein the secondary valve further includes a sleeve disposed movably within the secondary housing, the sleeve having an opening alignable with the port to open the secondary valve or misalignable with the port to close the secondary valve.

Embodiment 8: The injection valve as in any prior embodiment, wherein the sleeve is connected to a piston rod exposed at one end to uphole pressure and at an opposite end to downhole pressure, when in use.

Embodiment 9: The injection valve as in any prior embodiment, wherein the sleeve includes two seals thereon, the seals being of the same area, or different areas from one another.

Embodiment 10: The injection valve as in any prior embodiment, wherein the piston rod is disposed in a piston chamber of a flow distribution member connecting internal uphole fluid pressure to a volume of the injection valve occupied by the annular pressure-drop ring.

Embodiment 11: The injection valve as in any prior embodiment, wherein the secondary valve also includes a biasing member biasing the secondary valve to a closed position and wherein the secondary valve moves to an open position when uphole pressure exceeds downhole pressure and a force of the biasing member, during use.

Embodiment 12: The injection valve as in any prior embodiment, wherein the annular pressure-drop ring causes the downhole pressure to be lower than the uphole pressure.

Embodiment 13: A two-stage injection control system including a primary valve having a flapper and a flow tube and having a differential pressure seal radially outwardly of the flow tube, the flow tube responsive to a first pressure applied from uphole of the system, a secondary valve responsive to a second pressure higher than the first pressure to open the secondary valve, and an annular pressure-drop ring disposed between the primary valve and the secondary valve reducing flowing pressure through the secondary valve to maintain uphole pressure above the second pressure such that the primary valve and the secondary valve remain open, during use.

Embodiment 14: The system as in any prior embodiment, wherein the annular pressure-drop ring defines a number of fixed dimension orifices disposed about the ring.

Embodiment 15: A method for sequestering a fluid in a formation including pumping the fluid into a borehole through a two-stage injection control system as in any prior embodiment, opening the primary valve using differential pressure across the differential pressure seal, increasing pressure applied to the system; opening the secondary valve with the increased pressure, maintaining the increased pressure with the annular pressure-drop ring flowing the fluid through the secondary valve at reduced pressure.

Embodiment 16: The method as in any prior embodiment, wherein the reduced pressure is greater than a phase change pressure and temperature of the fluid to prevent fluid flashing.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An injection valve comprising:

a primary valve having:

a flapper;

a flapper seat configured to seat the flapper; and a flow tube disposed to move relative to the flapper and thereby cause the flapper to be unseated from the flapper seat;

a secondary valve disposed within the flow tube, the secondary valve including:

a secondary housing; and an openable and closable flow port through the secondary housing; and an annular pressure-drop ring including a number of fixed dimension orifices disposed about the ring, the ring disposed between the secondary housing and the flow tube.

2. The injection valve as claimed in claim 1 wherein the primary valve further includes a primary housing radially outwardly disposed of the flow tube and a seal disposed between the primary housing and the flow tube.

3. The injection valve as claimed in claim 1 wherein the annular pressure-drop ring is removable and replaceable with a ring having a different number or different dimensions of orifices to adjust pressure drop across the ring.

4. The injection valve as claimed in claim 1 wherein the number of orifices are of the same dimensions as each other.

5. The injection valve as claimed in claim 1 wherein the orifices extend in parallel to a longitudinal axis of the ring.

6. The injection valve as claimed in claim 1 wherein the secondary valve further includes a sleeve disposed movably within the secondary housing, the sleeve having an opening alignable with the port to open the secondary valve or misalignable with the port to close the secondary valve.

7. The injection valve as claimed in claim 6 wherein the sleeve is connected to a piston rod exposed at one end to uphole pressure and at an opposite end to downhole pressure, when in use.

8. The injection valve as claimed in claim 6 wherein the sleeve includes two seals thereon, the seals being of the same area, or different areas from one another.

9. The injection valve as claimed in claim 7 wherein the piston rod is disposed in a piston chamber of a flow distribution member connecting internal uphole fluid pressure to a volume of the injection valve occupied by the annular pressure-drop ring.

10. The injection valve as claimed in claim 7 wherein the secondary valve also includes a biasing member biasing the secondary valve to a closed position and wherein the secondary valve moves to an open position when uphole pressure exceeds downhole pressure and a force of the biasing member, during use.

11. The injection valve as claimed in claim 1 wherein the annular pressure-drop ring causes the downhole pressure to be lower than the uphole pressure.

12. A wellbore system comprising:

a borehole in a subsurface formation;

a string in the borehole; and an injection valve as claimed in claim 1 disposed with the string.

13. A two-stage injection control system comprising:

a primary valve having a flapper and a flow tube and having a differential pressure seal radially outwardly of the flow tube, the flow tube responsive to a first pressure applied from uphole of the system;

a secondary valve responsive to a second pressure higher than the first pressure to open the secondary valve; and an annular pressure-drop ring disposed between the primary valve and the secondary valve reducing flowing pressure through the secondary valve to maintain uphole pressure above the second pressure such that the primary valve and the secondary valve remain open, during use.

14. The system as claimed in claim 13 wherein the annular pressure-drop ring defines a number of fixed dimension orifices disposed about the ring.

15. A method for sequestering a fluid in a formation comprising:

pumping the fluid into a borehole through a two-stage injection control system as claimed in claim 13;

opening the primary valve using differential pressure across the differential pressure seal;

increasing pressure applied to the system;

opening the secondary valve with the increased pressure;

maintaining the increased pressure with the annular pressure-drop ring;

flowing the fluid through the secondary valve at reduced pressure.

16. The method as claimed in claim 15 wherein the reduced pressure is greater than a phase change pressure and temperature of the fluid to prevent fluid flashing.

* * * * *